US005414946A

United States Patent [19]

Leon

[11] Patent Number: 5,414,946

[45] Date of Patent: May 16, 1995

[54] MULTI-PURPOSE DOCUMENT HOLDER

[76] Inventor: Randy A. Leon, 168 W. Elm St., Phoenix, Ariz. 85013

[21] Appl. No.: 75,727

[22] Filed: Jun. 14, 1993

[51] Int. Cl.[6] ..... B41J 11/64

[52] U.S. Cl. ..... 40/353; 40/904

[58] Field of Search ..... 40/352, 353, 354, 355, 40/152.1, 904

[56] References Cited

U.S. PATENT DOCUMENTS

| | | | |
|---|---|---|---|
| 1,759,544 | 5/1930 | Cross | 40/904 |
| 2,541,513 | 2/1951 | Hassett | 40/352 |
| 2,871,816 | 2/1959 | McConnell | 40/352 X |
| 2,981,231 | 4/1961 | Howard | 40/352 |
| 3,328,899 | 7/1967 | Stewart | 40/904 X |

*Primary Examiner*—Kenneth J. Dorner
*Assistant Examiner*—Cassandra H. Davis
*Attorney, Agent, or Firm*—Michael J. D'Amelio; Sandra L. Etherton

[57] ABSTRACT

A multi-purpose document holder which can be used with documents printed in either the landscape or portrait positions. Adjustably slidable line-guides are used to indicate a position within a document. Line-guides are provided for use of the device in both the landscape and portrait positions, and can be incorporated into the device as removable or non-removable members. This multi-purpose document holder is further provided with a document chamber having a spring-loaded backing plate to accommodate a stack of documents while maintaining the topmost document in contact with a line-guide. A document storage compartment is provided to house completed work, and a bi-functional stand is used to hold the device in a substantially vertical position when used in either the landscape or portrait positions.

11 Claims, 2 Drawing Sheets

MULTI-PURPOSE DOCUMENT HOLDER

BACKGROUND OF THE INVENTION

1. Technical Field of the Invention

The present invention relates to the field of document holders used for ease in viewing documents by typists, computer users, and the like. More specifically, this invention relates to a desk-top multi-document holder which can be used in either the landscape or portrait positions.

2. Prior Background Art

The prior art is replete with devices used to support documents, copies, drafts, and reports for the convenience and efficiency of typists, computer users, and the like. Typically, these devices rest on a table surface in front of the user and next to the computer or typewriter. The device is held in an upright position with any conventional stand assembly.

One component usually included in prior art devices is a line-guide or ruler, the position of which can be adjusted over a document held in the device to indicate a given line of text or figures. In this way, the user does not lose his or her place while working with the document and minimizes mistakes.

In the modern office setting, there is a need for a document holder which accommodates not only the traditional page of text printed in the portrait, or vertical, position, but also pages of text, figures, symbols, charts, engineering and accounting reports, and various other types of data, printed on a page in the landscape, or horizontal, position. Additionally, there is a need for a device which offers more than just a ruler or line-guide to indicate a portion of the document held in the device.

Devices in the prior art have generally failed at meeting these needs, or have done so in expensive and cumbersome ways. Most only offer accommodation of documents printed in the portrait position. Some are expensive and require time consuming manual adjustment for various paper sizes and line-guide positioning. Still others require the addition of extension panels or other inconvenient component parts to accommodate various paper sizes and documents printed in alternative orientations.

The present invention provides a simple, relatively inexpensive device that is extremely easy to use and requires no time consuming manual adjustments, or addition of extension panels or other cumbersome component parts, to accommodate different document orientations or paper sizes. The present invention is usable in either the landscape or portrait position simply by rotating the device by 90 degrees. Additionally, the present device provides a multiple-function line-guide to accommodate users with special needs.

SUMMARY DESCRIPTION OF THE INVENTION

The present invention is a multi-purpose document holder comprising a basically planar body supportable on a support surface in either the landscape or portrait position using a bi-functional stand. The device further comprises a frame with tracking along its inner periphery which engages mating tracking on either end of both a landscape-position line-guide and a portrait-position line-guide. Each line-guide is removed or inserted dependent upon which orientation the device is used in. Each line-guide is also slidably adjustable over a document placed in the device and positionable so as to indicate a given portion of the document.

Further, to meet a user's special needs, each line-guide may be supplied with gradations along its edges, an open slot along its longitudinal centerline, a magnifying strip along its longitudinal centerline, or any combination of these features.

The device may also be supplied with a document chamber, positioned behind the frame and line-guides, having a spring-loaded backing plate designed to accommodate a stack of documents within the chamber while keeping the topmost document in contact with the line-guides at all times during use. Additionally, the device may be supplied with a document storage compartment in which completed documents may be deposited.

An alternative embodiment of the present invention contemplates non-removable portrait and landscape position line-guides, each with tracking on both ends and along one longitudinal edge. A square spacer is fixed within a corner of the frame such that when each line guide is slidably adjusted so as to come into full contact with the spacer and Also the edge of the frame adjacent to the spacer, a rectangular open area the size of documents to be inserted into the device is delineated by boundaries comprising two adjacent sides of the frame and both line-guides. After insertion of a document, or stack of documents, this embodiment may be used in either the landscape or the portrait position by adjustably sliding either line-guide along two parallel tracks formed by a tracked inner edge of the frame and an opposing track consisting of an exposed tracked edge of the spacer and the tracked edge of the other line-guide.

DETAILS OF BEST MODE FOR CARRYING OUT THE INVENTION

Figure 1:
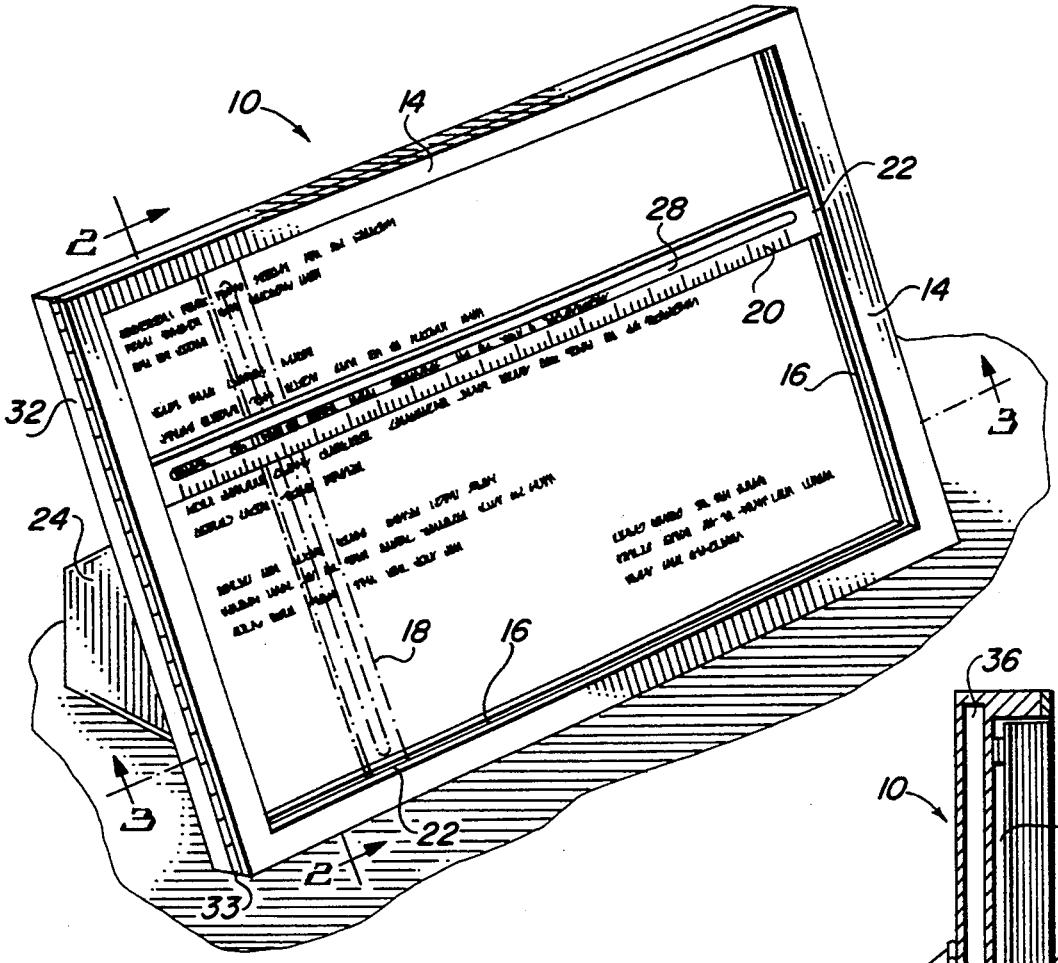
FIG. 1 shows an elevational perspective view of an embodiment of the present invention in the landscape position, further showing the landscape-position line-guide; the portrait-position line-guide is shown in phantom.
Figure 2:
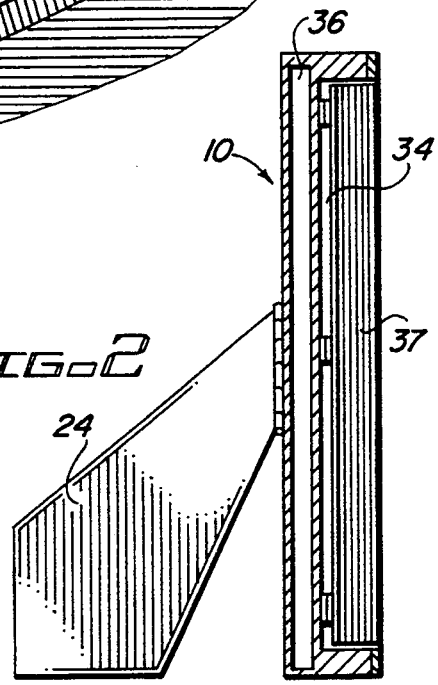
FIG. 2 shows a side elevational sectional view of the present invention along line 2—2 of FIG. 1, the invention being arranged upright in the landscape position by means of a stand assembly, and hingedly mounted on a document chamber and a document depository.
Figure 4:
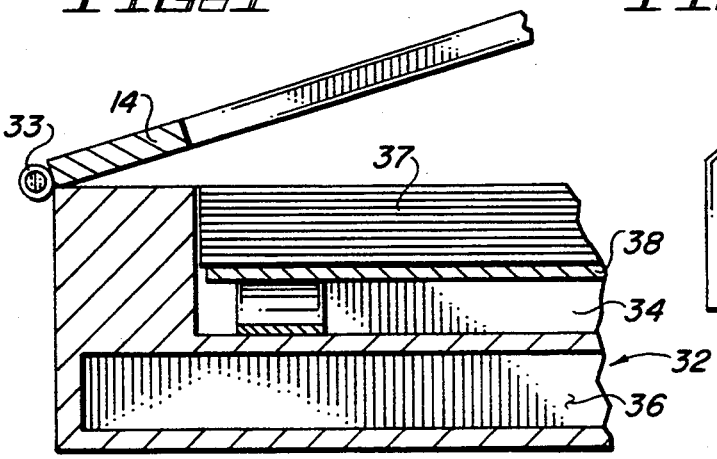
FIG. 4 shows an exploded view of the hinged area of FIG. 3, further detailing a stack of documents on the spring-loaded backing plate within the document chamber.

For purposes of promoting an understanding of the principles of the invention, reference will now be made to the embodiments illustrated in the drawings and specific language will be used to describe them. It will nevertheless be understood that no limitation of the scope of the invention is thereby intended. Alterations and modifications of the illustrated device are contemplated, as are such further applications of the principles of the invention as would normally occur to one skilled in the art to which the invention pertains.

Device 10 can be manufactured from any suitable material such as metal, wood, plastic, etc. Plastic is the preferred material so as to minimize the cost and weight of device 10, and to simplify the manufacturing process. Device 10 can also be manufactured to accommodate various document sizes, such as $8\frac{1}{2}''\times 11''$, $8\frac{1}{2}''\times 14''$, $11''\times 17''$, etc. Clearly, larger sizes of device 10 can be used with smaller sized documents.

Figure 7:
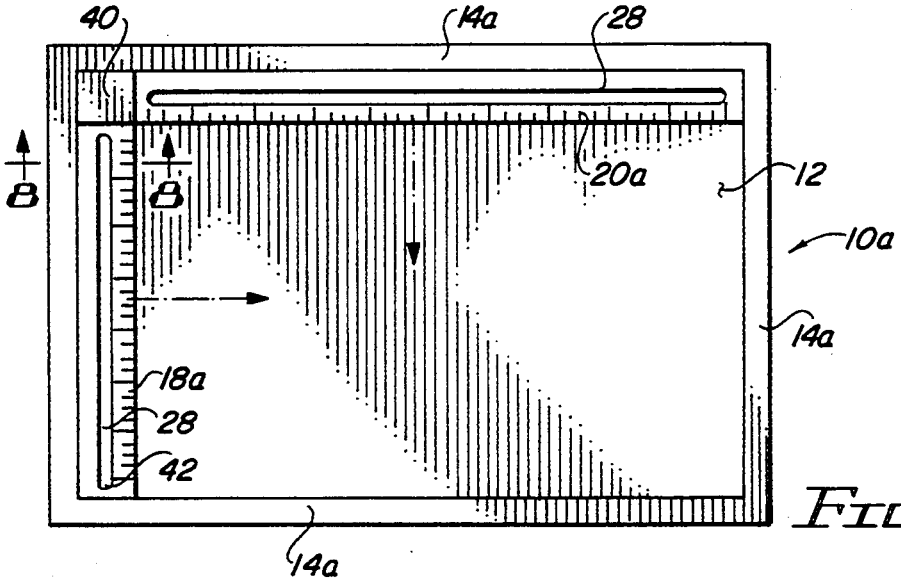
FIG. 7 shows an alternative embodiment of the present invention in which both line-guides are non-removable and each line-guide doubles as a tracking edge when the other line-guide is in use.
Figure 8:
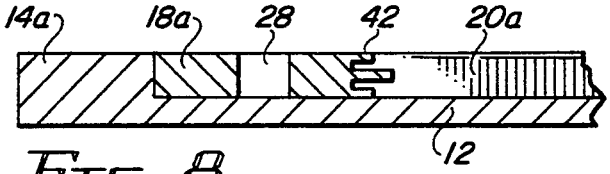
FIG. 8 shows a sectional view along line 8—8 of FIG. 7, detailing the mating of the portrait-position line-guide edge tracking and the landscape-position line-guide end tracking.

Device 10 is comprised of backing plate 12, shown in FIG. 7, with frame 14 fixed along its periphery. Frame 14 has integral frame tracking 16 along its inner edges to facilitate adjustable positioning of portrait line-guide 18 and landscape line-guide 20. This is accomplished through line-guide tracking 22, located at opposing ends of each of portrait line-guide 18 and landscape line-guide 20, which forms a secure, mating, slidable fit when engaged with frame tracking 16.

When device 10 is used in the landscape position, portrait line-guide 18 is set aside, and landscape line-guide 20 is inserted into the position shown in FIG. 1. This is accomplished by bending it slightly to reduce its overall length to that which can be fit between opposing parallel portions of frame tracking 16. When set in place and released, landscape line-guide 20 springs back into a flat position thereby restoring its original length and engaging line-guide tracking 22 at its ends with frame tracking 16. Landscape line-guide 20 is manufactured with respect to frame 14 so as to produce a tracking engagement which allows slidable adjustment of landscape line-guide 20 over a document placed in device 10, and also allows maintenance of landscape line-guide 20 in a substantially parallel position with respect to the lines of text or data on the document. To use device 10 in the portrait position, landscape line-guide 20 is removed and set aside and portrait line-guide 18 is inserted into device 10 as described above.

Figure 3:
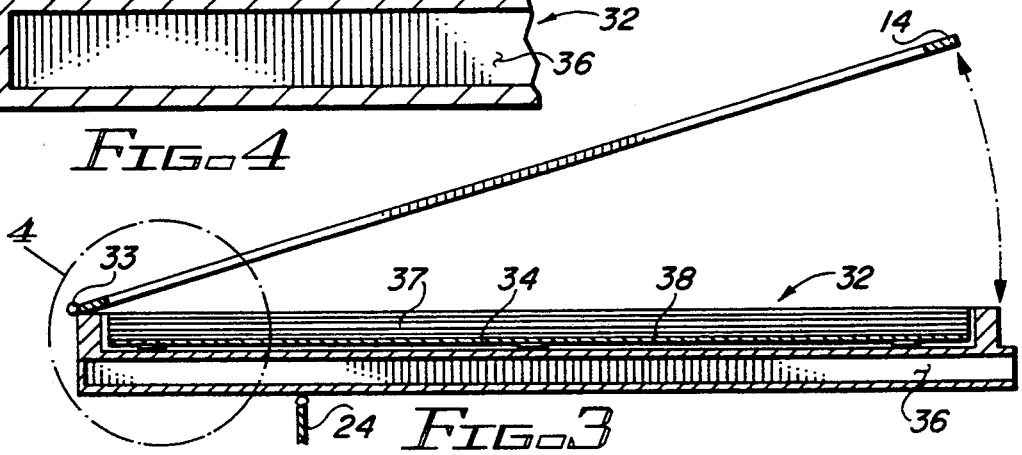
FIG. 3 shows a bottom sectional view of the present invention along line 3—3 of FIG. 1, the invention being hingedly mounted on a document chamber and a document depository.

Device 10 may be used laying flat on a table or desk surface, or may be propped up to a substantially vertical position for the convenience of a user who is simultaneously typing into a typewriter, computer, or the like. This is accomplished through bi-functional stand 24 which is hingedly attached to backing plate 12 as shown in FIG. 3. Bi-functional stand 24 is configured and attached to backing plate 12 so as to provide device 10 with the ability to rest on a flat surface in a substantially vertical position when used in either the landscape or portrait positions.

Figure 5:
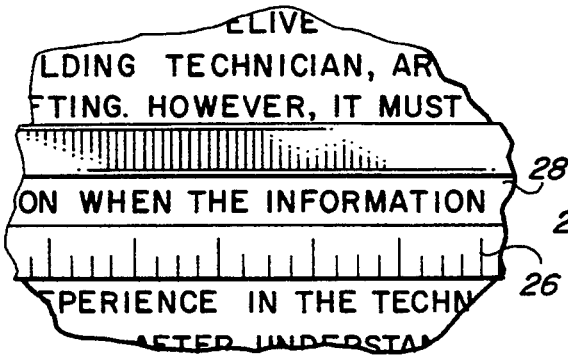
FIG. 5 shows an exploded view of a portion of a line-guide, further showing gradations along one edge and a viewing slot along the longitudinal centerline of the line-guide.
Figure 6:
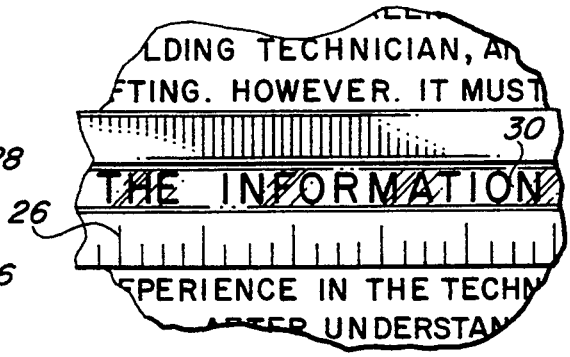
FIG. 6 shows an exploded view of a portion of a line-guide, further showing gradations along one edge and a magnifying strip along the longitudinal centerline of the line-guide.

Both portrait line-guide 18 and landscape line-guide 20 may be provided with gradations 26, as shown in FIGS. 5 & 6, along their edges in inches, centimeters, etc., with open slot 28 along their longitudinal centerlines for viewing or marking lines of print, or with magnifying lens 30 along their longitudinal centerlines for aiding a user in seeing small print. Line-guides 18 and 20 may also be provided with combinations of these features in a single unit.

Figure 9:
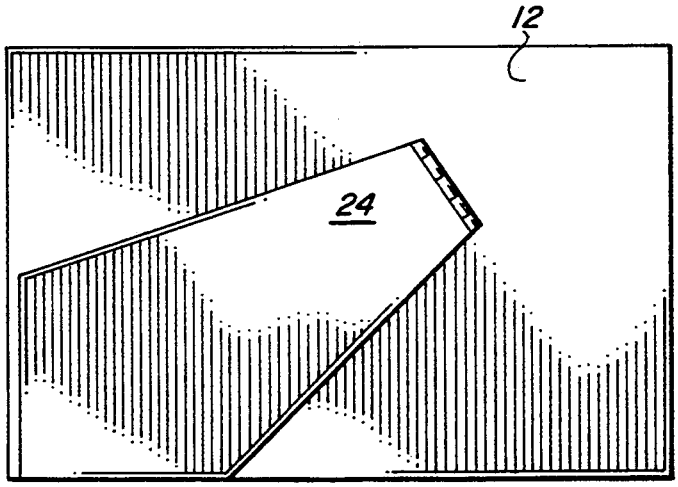
FIG. 9 shows a bi-functional stand hingedly attached to the device.

Device 10 may be supplied with additional features by the elimination of backing plate 12. Frame 14 may be hingedly attached to base unit 32 with hinges 33. Base unit 32 comprises document chamber 34 and document depository 36. Document stack 37 may be inserted into document chamber 34 in preparing for work on a multipage report or the like. Regardless of the thickness of document stack 37, the topmost document is held in contact with either of line-guides 18 or 20 through spring-loaded backing plate 38 mounted within document chamber 34. As the user's work on each document in stack 37 is completed, the topmost document may be removed by opening frame 14, thereby leaving the next successive document in stack 37 exposed for the user's convenience. The completed document may then be inserted into document depository 36 for storage, to eliminate the risk of mixing up or losing documents.

stand 24 may be attached to base unit 32 as described above and as shown in FIG. 9 to provide means for using device 10 in a substantially vertical position in either the landscape or portrait position.

An alternative embodiment, device **10*a* shown in FIG. 7, eliminates the need for interchangeable line-guides when changing the orientation of device 10*a*. Frame 14*a* is increased in both horizontal and vertical dimension by a factor equal to the width of line-guides 18*a* and 20*a*. Square spacer 40 is fixed into a corner of frame 14*a* and is of a dimension equal to the width of line-guides 18*a* and 20*a*. The two exposed edges of square spacer 40 are provided with the same tracking configuration as is located on the inner periphery of frame 14*a*. Each of line-guides 18*a* and 20*a* are provided with one edge that incorporates the tracking configuration of frame 14*a* such that when, for example, portrait line-guide 18*a* is slid into a position in which its end is in contact with square spacer 40 and its length is in contact with frame 14*a*, device 10*a* may be used in the landscape position. Landscape line-guide 20*a* is then free to adjustably slide along parallel tracks, one formed by edge 42 of portrait line-guide 18*a* and an aligned edge of spacer 40, and the other being the opposing inner edge of frame 14*a***.

Device **10*a* is usable in the portrait position simply by adjusting landscape line-guide 20*a* into the appropriate position, as described above, thereby allowing portrait line-guide 18*a* to adjustably slide along parallel tracks, similar to those described above. With this embodiment, neither of line-guides 18*a* or 20*a* need be removed from device 10*a* at any time, and the open rectangular area within frame 14*a*** remains of a size large enough to receive an appropriate sized document.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such clear and concise manner that those skilled in the art may readily understand and practice the invention, that which is claimed is:

1. A document holder comprising:

a. a rectangular planar member having a latitudinal centerline and a longitudinal centerline;

b. a rectangular frame member, said frame member being fixedly attached to a periphery of an operative side of said rectangular planar member, and said frame member further comprising integral frame tracking means along an inner circumference of said frame member;

c. a removable portrait-position line-guide of a length substantially equal to the distance between opposing parallel frame tracking means and along said latitudinal centerline of said rectangular planar member, said portrait-position line-guide further comprising line-guide tracking means at each end, said line-guide tracking means being slidably engageable with said frame tracking means along opposing sides of said frame member and in a direction parallel to said longitudinal centerline of said rectangular planar member; and d. a removable landscape-position line-guide of a length substantially equal to the distance between opposing parallel frame tracking means and along said longitudinal centerline of said rectangular planar member, said landscape-position line-guide further comprising line-guide tracking means at each end, said line-guide tracking means being slidably engageable with said frame tracking means along opposing sides of said frame member and in a direction parallel to said latitudinal centerline of said rectangular planar member.

2. The document holder of claim 1, wherein said landscape-position line-guide and said portrait-position line-guide further comprise at least one of the following:

a. gradations along longitudinal edges of said line-guides;

b. an open slot along longitudinal centerlines of said line-guides; and c. a magnifying strip along said longitudinal centerlines of said line-guides.

3. The document holder of claim 2, further comprising a document storage compartment integral to a non-operative side of said rectangular planar member.

4. The document holder of claim 2, further comprising bi-functional means for supporting said document holder in a substantially vertical orientation on a flat horizontally planar surface, said bi-functional means being operable with use of said document holder in either a landscape or a portrait position.

5. The document holder of claim 3, further comprising bi-functional means for supporting said document holder in a substantially vertical orientation on a flat horizontally planar surface, said bi-functional means being operable with use of said document holder in either a landscape or a portrait position.

6. A document holder comprising:

a. rectangular frame member having a latitudinal centerline and a longitudinal centerline, said frame member further comprising integral frame tracking means along an inner circumference of said frame member;

b. a removable portrait-position line-guide of a length substantially equal to the distance between opposing parallel frame tracking means and along said latitudinal centerline of said rectangular frame member, said portrait-position line-guide further comprising line-guide tracking means at each end, said line-guide tracking means being slidably engageable with said frame tracking means along opposing sides of said frame member and in a direction parallel to said longitudinal centerline of said rectangular frame member; and c. a removable landscape-position line-guide of a length substantially equal to the distance between opposing parallel frame tracking means and along said longitudinal centerline of said rectangular frame member, said landscape-position line-guide further comprising line-guide tracking means at each end, said line-guide tracking means being slidably engageable with said frame tracking means along opposing sides of said frame member and in a direction parallel to said latitudinal centerline of said rectangular frame member.

7. The document holder of claim 6, wherein said landscape-position line-guide and said portrait-position line-guide further comprise at least one of the following:

a. gradations along longitudinal edges of said line-guides;

b. an open slot along longitudinal centerlines of said line-guides; and c. a magnifying strip along said longitudinal centerlines of said line-guides.

8. The document holder of claim 7, further comprising a document chamber, said chamber being rectangularly shaped and substantially equivalent in size to said rectangular frame member, said chamber also being hingedly connected to said frame member, with at least one hinge, along an edge of said chamber and an edge of said frame member, said edges being substantially equal in length, said chamber further comprising compression means within an operative side of said chamber for maintaining a topmost document, in a stack of documents within said chamber, in contact with said line-guides.

9. The document holder of claim 8, further comprising a document storage compartment integral to a non-operative side of said document chamber.

10. The document holder of claim 8, further comprising bi-functional means for supporting said document holder in a substantially vertical orientation on a flat horizontally planar surface, said bi-functional means being operable with use of said document holder in either a landscape or a portrait position.

11. The document holder of claim 9, further comprising bi-functional means for supporting said document holder in a substantially vertical orientation on a flat horizontally planar surface, said bi-functional means being operable with use of said document holder in either a landscape or a portrait position.

* * * * *